United States Patent [19]

Thompson

[11] 4,062,017

[45] Dec. 6, 1977

[54] MULTIPLE FREQUENCY BAND ANTENNA

[76] Inventor: Wallace T. Thompson, 10528 Tomwood Ave., El Paso, Tex. 79925

[21] Appl. No.: 633,928

[22] Filed: Nov. 20, 1975

[51] Int. Cl.[2] ..... H01Q 1/14; H01Q 21/28

[52] U.S. Cl. ..... 343/722; 343/727; 343/822; 343/886

[58] Field of Search ..... 343/722, 820, 821, 822, 343/727, 816, 886

[56] References Cited

U.S. PATENT DOCUMENTS 3,534,371 10/1970 Seavey ..... 343/722

*Primary Examiner*—Eli Lieberman

*Attorney, Agent, or Firm*—Stevens, Davis, Miller & Mosher

[57] ABSTRACT

An antenna configuration in which multiple frequency band coverage is obtained in simple structures. This invention is most useful in the high-frequency spectrum where other techniques of providing multiple frequency operation become physically difficult to implement. The antenna configuration includes a multiplicity of conductor elements, a coaxial cable network for interconnection of the elements and connection to a feedline, and a high permeability core to aid decoupling to the feedline exterior from the antenna proper.

7 Claims, 9 Drawing Figures

MULTIPLE FREQUENCY BAND ANTENNA

BACKGROUND OF THE INVENTION

This invention relates to radio antenna apparatus and it particularly relates to an antenna configuration which is useful for providing multiple band and frequency coverage while employing a single feedline to supply and receive radio frequency energy.

One of the more difficult problems in radio antenna construction and performance is that of achieving a high degree of efficiency while maintaining a correct impedance match across a wide range of frequencies. An antenna element typically exhibits resonance wherein it absorbs energy from a source such as a transmission line and transmitter more readily at some frequencies than at others.

It is often desirable to have communications capability at various frequencies throughout the high frequency spectrum. A high frequency band antenna should be effective on as many frequencies as possible. Resonance behavior inhibits effective impedance matching between the transmitter and antenna. A structure which reduces the effects of resonance behavior will provide improved impedance matching. A typical definition of the useful bandwidth of an antenna would be those spectrum regions where the voltage-standing-wave-ratio is three-to-one or less. Some critical applications might call for two-to-one and some non-critical applications might well tolerate five-to-one or six-to-one values of voltage-standing-wave-ratio. Absolute perfection of a one-to-one voltage-standing-wave-ratio is rarely necessary and generally achieved only with antennas designed to operate on a single discrete frequency.

There are numerous versions of prior-art antenna configurations with wideband, multiple-band or all-frequency performance in the high-frequency spectrum.

Techniques which are employed include the use of manual tuning or servomechanism tuning so as to regain resonance and proper impedance matching. While effective, this technique is unwieldy or expensive.

Also included are multiple antennas, connected to a common feed point, each accepting radio frequency energy at its own resonant frequency. When the number of bands becomes high, this configuration becomes difficult to adjust and suffers from appearance and practical construction problems.

Further techniques are the use of tuned circuit elements or transmission line segments to act as bandstop networks which electronically disconnect portions of an antenna structure so that the remainder is resonant. These are commonly called "traps" and are effective for two or three band performance. Since the components employed are subjected to high voltage, care is required in the basic design to provide adequately rated components and humidity-resistant construction.

Prior art also includes the use of resistive termination elements, which, by sacrificing efficiency, can reduce reflected waves on the antenna and improve its behavior across frequency spans.

Recent technology includes the use of structures which show repetitive ratio construction with each fixed frequency change percentage. Known as "log-periodic" structures, these are probably the most successful in providing wide bandwidth performance. Such structures are generally neither simple nor inexpensive when implemented in the high-frequency region of the spectrum.

A review of available techniques shows there remains a need for a relatively simple, inexpensive structure which provides efficient radiation and moderately good impedance matching characteristics over a number of bands.

OBJECTS AND SUMMARY OF THE INVENTION

It is an important object of this invention to provide an antenna structure and design capable of useful operation in multiple radio service bands in the high-frequency spectrum.

It is also an object of this invention to provide an antenna structure characterized by simplicity, ease of construction and unobtrusive appearance.

It is also an important object of this invention to provide an antenna structure which is capable of operation in non-critical applications in the entire high-frequency spectrum of 3 Megahertz to 30 Megahertz.

It is an object of this invention to provide an antenna structure with a single feedline.

It is also an object of this invention not to use resistive elements as part of the antenna structure for the purpose of improving impedance matching by sacrificing efficiency.

It is also an important object of this invention to provide a design which achieves decoupling of the radio frequency energy in the antenna from the exterior of a coaxial-cable-feedline supplying that energy.

It is also an important object of this invention to provide a design which possesses the versatility of a degree of selection in frequency where the optimum operating bands are located, extending the useful frequencies above and below the high-frequency spectrum.

It is an object of this invention to allow a feed arrangement at a point nearer one end of the antenna structure.

It is also an important object of this invention to provide a design which is capable of adding mechanical guying strength to a radio tower.

Further purposes and objects of this invention will become apparent as the specification proceeds.

All of the foregoing objects are provided by an embodiment of my improved antenna design wherein the antenna comprises a multiplicity of elements connected to a common feed assembly and the feed assembly is comprised of a bracket providing mounting means, a coaxial-cable-network providing electrical connection means, a connector providing feedline attachment means, a high permeability core providing mechanical winding and electrical decoupling means, and associated hardware providing environmental protection means and means to secure the assembly together.

BRIEF DESCRIPTION OF THE DRAWINGS

Referring to the accompanying drawings, a particular embodiment of the present invention is illustrated, wherein.

DETAILED DESCRIPTION OF THE PREFERRED EMBODIMENT

Figure 1:
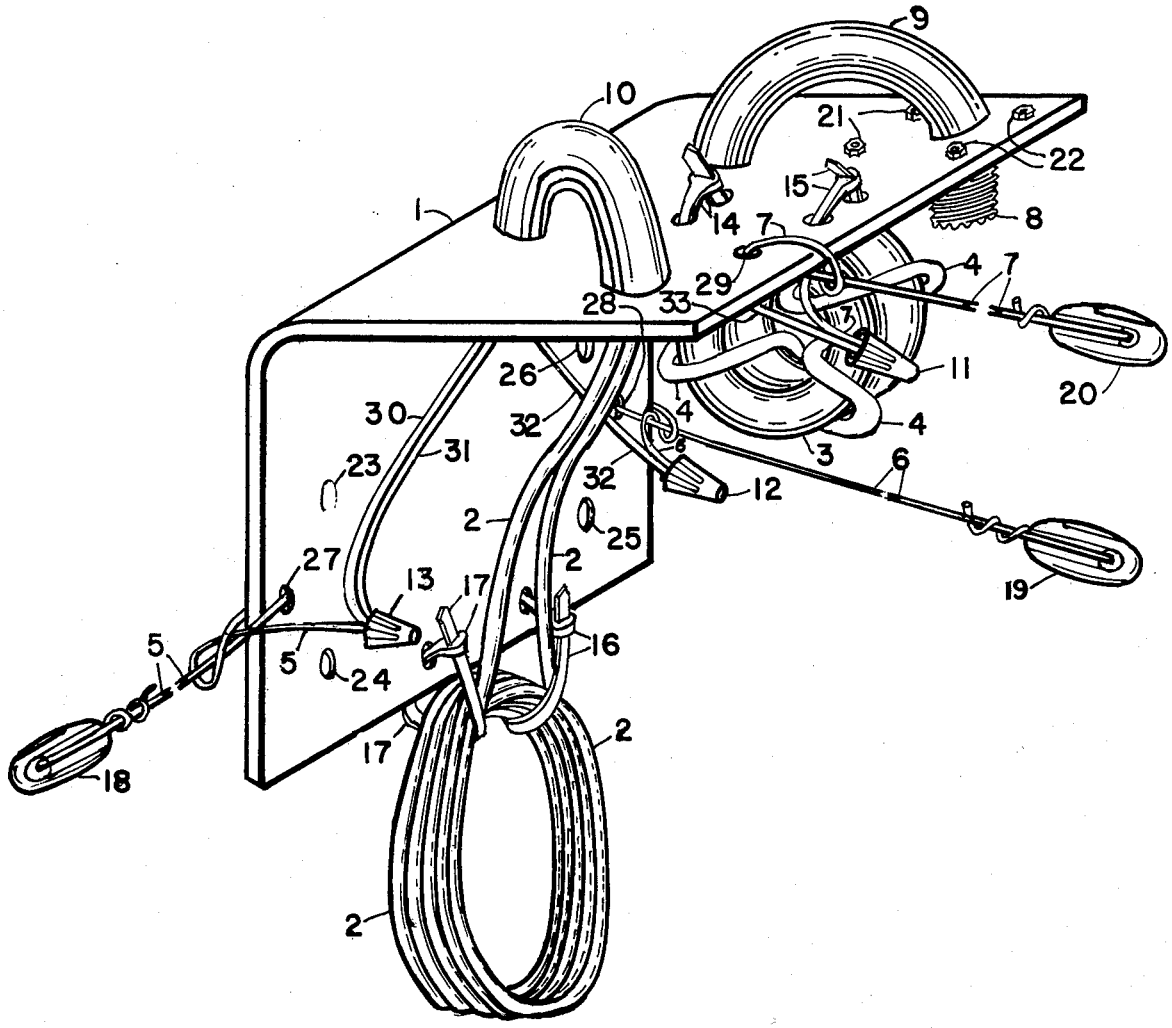
FIG. 1 is an oblique perspective view showing my antenna invention.
Figure 2:
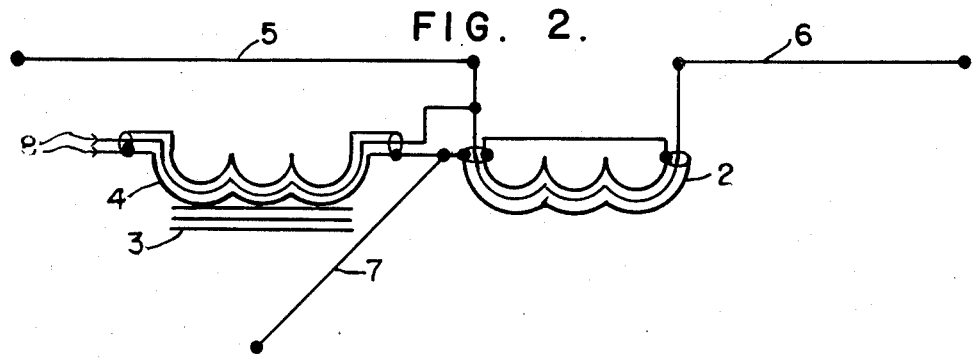
FIG. 2 is a schematic diagram of my antenna invention.

Referring to FIGS. 1 and 2, the preferred embodiment of the antenna is shown in detail. FIG. 1 is an oblique view of the antenna while FIG. 2 is a schematic diagram of the antenna.

An insulating bracket 1, made of a non-conducting, high-strength material suitable for exposure to weathering is employed to mount the components of the antenna. The insulator bracket 1 is attached to its support in turn by bolts or other means through mounting holes 23, 24, 25 and 26. The wire radiating elements 5, 6 and 7 are secured to the insulator bracket 1 by connection through their respective tie holes 27, 28 and 29. Connector 8 provides a means to attach a coaxial feedline to the antenna. A coaxial cable 4 exits connector 8, passing through protective sleeve 9 and then is wrapped in multiple turns through toroidal core 3. The toroidal core 3 is made of a material having high magnetic permeability. The toroidal core 3 and cable 4 assembly is secured to the insulator bracket 1 by two tie straps 14 and 15 which pass through appropriately located holes in the insulator bracket 1. From the toroidal core 3, the coaxial cable 4 continues through protective sleeve 10. The center conductor 30 of coaxial cable 4 is connected to antenna wire 5 and conductor 31 inside wire connector 13. The shield 33 of coaxial cable 4 exits protective sleeve 10 separately from the center conductor 30 and is connected to antenna wire 7 inside wire connector 11. Conductor 31 is the center conductor of coaxial cable 2. Coaxial cable 2 has an electrical length of substantially an integral multiple of one-half wavelengths at a frequency where antenna wires 5 and 6 together are half-wave resonant. The outer shield of coaxial cable 2 joins shield 33 of coaxial cable 4 inside protective sleeve 10. Only shield 33 is brought out of sleeve 10. Coaxial cable 2 passes through protective sleeve 10, is coiled at the base of the insulator bracket 1 and the far end of coaxial cable 2 then returns into protective sleeve 10. Coaxial cable 2 is attached to insulator bracket 1 by means of two tie straps 16 and 17. The shield of coaxial cable 2, at the far end, is also attached to shield 33 of coaxial cable 4. The center conductor 32 of coaxial cable 2 at the far end is brought out of protective sleeve 10 and connects to antenna wire 6 inside wire connector 12. The ends of antenna wires 5, 6 and 7 are terminated by insulators 18, 19 and 20 which are in turn used to attach support members which are not a part of the antenna proper. Connector 8 is secured to insulator bracket 1 by fasteners 21 and 22.

It will be apparent to those skilled in the art that a number of equivalent construction techniques are apparent and included within the scope of this invention. These include, but are not limited to, such techniques as alternate fastening members to secure the components in place, cylindrical rather than toroidal cores for the feedline decoupling choke, different lengths of coaxial cable 2 and rigid rather than wire antenna elements. The antenna may be also mounted with one or more elements vertical. The configuration of the preferred embodiment is chosen largely on the basis of low cost. Other configurations are suitable when needs dictate.

More specifically, a typical antenna constructed in accordance with my invention is believed to operate primarily as a half-wave dipole at higher wavelengths (such as the 80 and 40 meter bands) and as a 3, 5 and 6 half-wave antenna in the 20, 15 and 10 meter bands. At 160 meters, the antenna is believed to operate as a pair of monopoles fed by a quarter-wave phasing section and at 6 meters as a traveling wave antenna. While the theory of operation is not fully understood, it is believed that all three elements of the antenna are active and also interact on each band in such a way that there are generally two primary elements, the remaining element functioning as an impedance adjuster.

The following table shows which of the wire radiating elements 5, 6 and 7 are believed to function as the primary elements and summarizes what is believed to be their primary behavior:

| BAND (METERS) | PRIMARY BEHAVIOR | PRIMARY ELEMENTS |
|---|---|---|
| 160 | Two monopoles 90° out of phase | 5 and 6 |
| 80 | Off-center fed "Windom" doublet | 5 and 6 |
| 40 | $\lambda/2$ Doublet | 6 and 7 |
| 20 | 3 $\lambda/2$ Doublet | 5 and 7 |
| 15 | 5 $\lambda/2$ Doublet | 5 and 7 |
| 10 | 6 $\lambda/2$ Doublet | 5 and 7 |
| 6 | Traveling wave antenna | 5 and 7 |

Figure 3:
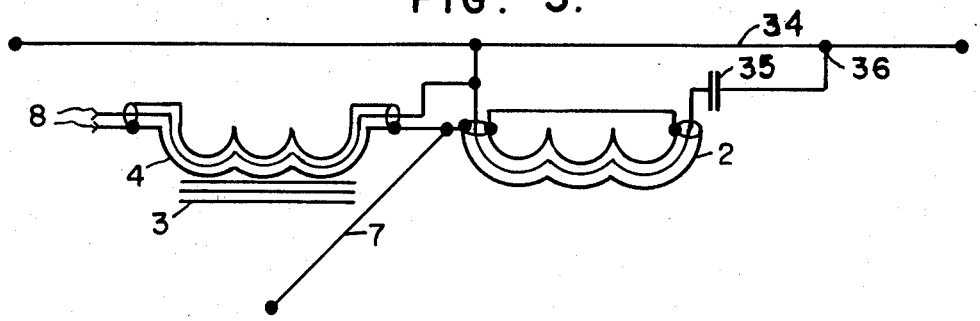
FIG. 3 is a schematic diagram of one of the useful variations of the basic antenna design.
Figure 4:
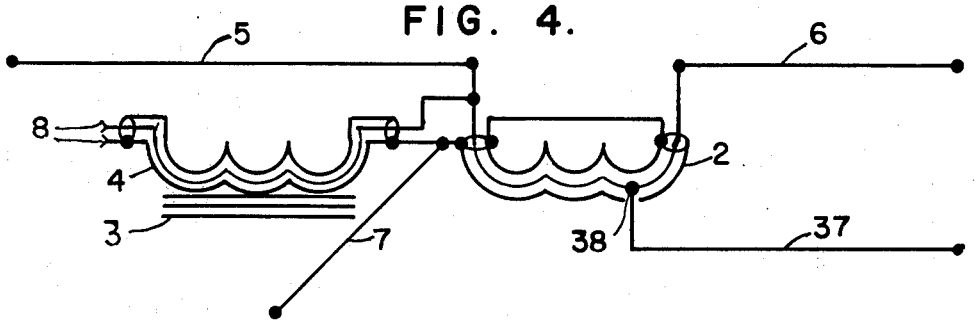
FIG. 4 is a schematic diagram of another useful variation of the basic antenna design.
Figure 5:
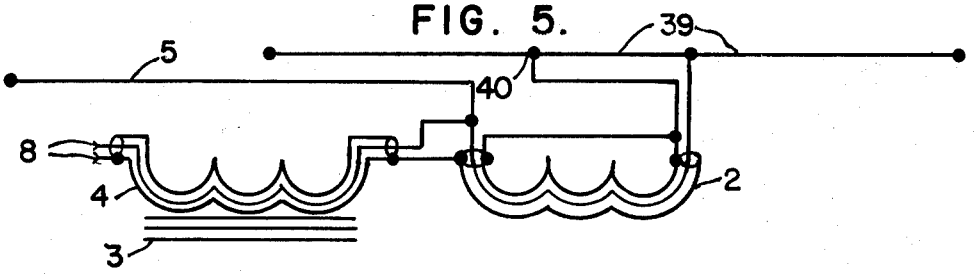
FIG. 5 is a schematic diagram of another useful variation of the basic antenna design.
Figure 6:
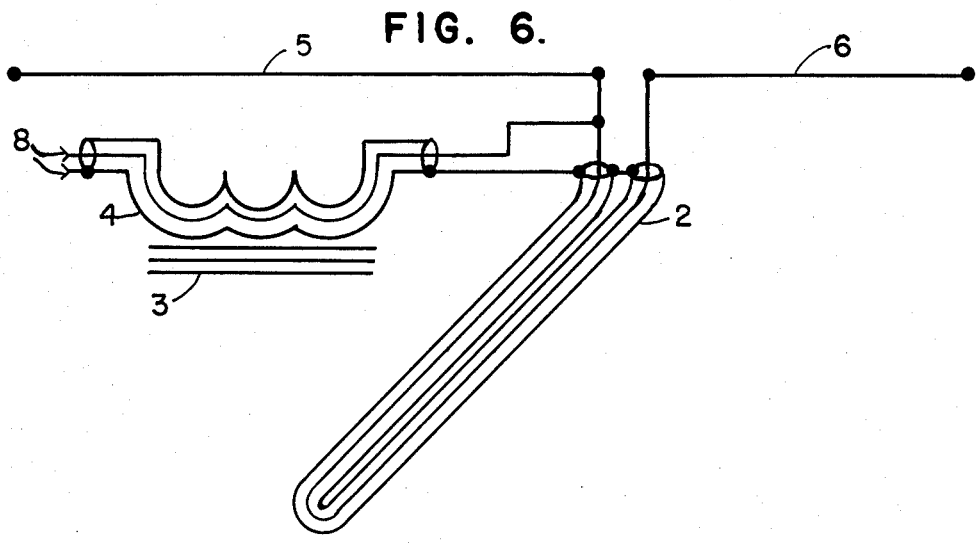
FIG. 6 is a schematic diagram of another useful variation of the basic antenna design.
Figure 7:
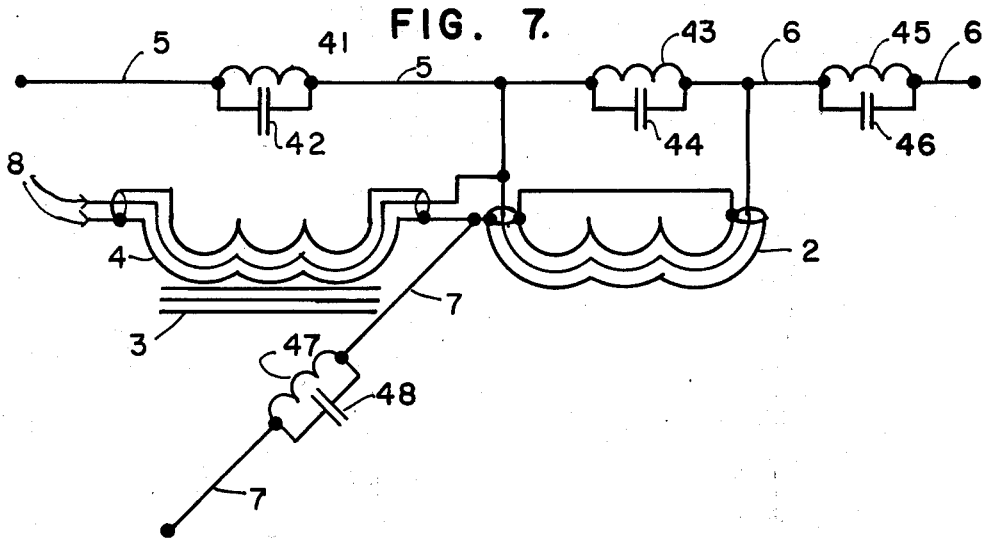
FIG. 7 is a schematic diagram of another useful variation of the basic antenna design.
Figure 8:
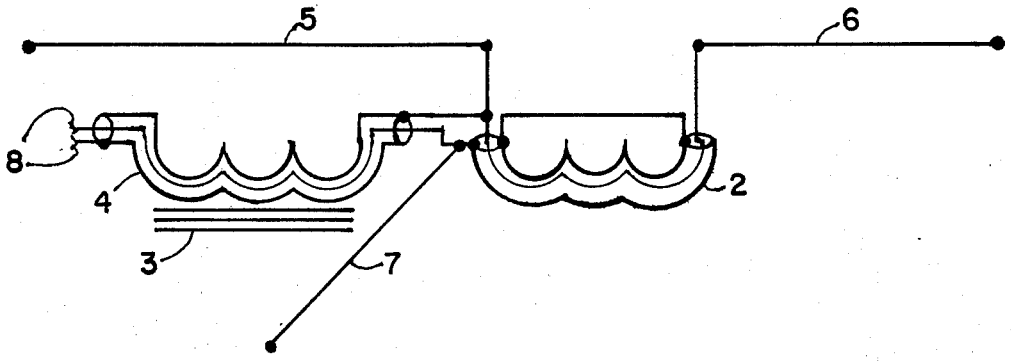
FIG. 8 is a schematic diagram of still another variation of the basic antenna design.
Figure 9:
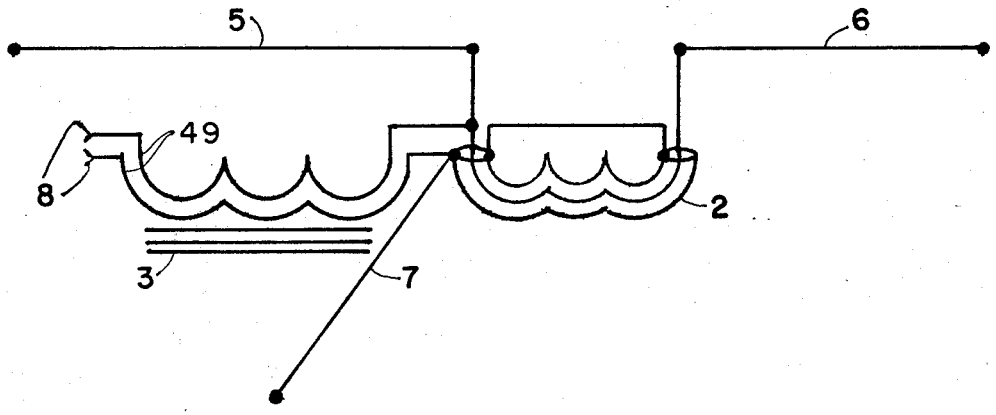
FIG. 9 is a schematic diagram of another variation of the basic antenna design.

It will also be apparent to those skilled in the art that there are useful variations in the basic configuration of this device which are included within the scope of the invention. Thus, FIG. 3 illustrates a variation wherein two of the antenna wire elements 5 and 7 are combined into a single conductor 34 and energy is transferred into the structure through a capacitor 35 and tap 36 onto this single conductor. Such impedance matching schemes are commonly called gamma-matching sections. FIG. 4 illustrates a schematic configuration of the antenna wherein another conductor element 37 has been added to the basic structure by adding a tap 38 to an intermediate position of the coaxial cable 2. Such taps allow the addition of specific conductor radiating elements to control the impedance characteristics at additional frequencies. FIG. 5 illustrates another configuration wherein two elements 6 and 7 are joined into a single element 39 and a tap 40 is used for energy transfer. This configuration allows the tap 40 to bring a direct-current ground to the antenna elements 39 and 5. It will also be apparent to those skilled in the art that the configuration of FIG. 6, wherein the coaxial cable 2 in FIG. 1 is uncoiled and positioned in place of wire element 7, can be usefully employed to save construction material at the sacrifice of appearance considerations. Wire element 7 would be eliminated altogether in such a configuration. It will also be apparent to those skilled in the art that lumped reactive components 41, 42, 43, 44, 45, 46, 47 and 48 may be employed singly or together to allow a smaller size structure or to allow additional resonances, as shown in FIG. 7. Traps or loading reactances may be inserted in the conductor elements of this antenna much as they are inserted in other, prior-art antenna structures. FIG. 8 illustrates the readily apparent variation wherein the connections between coaxial cable 4 and coaxial cable 2 are reversed from the connections shown in FIG. 2. Finally it is apparent to those skilled in the art that a parallel wire transmission line 49 may be substituted in place of coaxial cable 4 as shown in FIG. 9.

What is claimed is:

1. A multiple frequency band antenna for coupling to a feedline comprising:

a high permeability core;

a coaxial network including first and second input terminals for connection to said feedline, and first and second coaxial cables each comprising an electrically conductive shield having first and second ends and a center conductor having first and second ends, said first coaxial cable being wrapped about said high permeability core and having the first end of its center conductor and its shield connected to said first and second input terminals, the second end of the center conductor of said first coaxial cable being connected to the first end of the center conductor of said second coaxial cable, the conductive shields of said first and second coaxial cables being connected together; and first, second and third conductive radiation elements, said first element being coupled to the junction between the first and second ends of the center conductors of said first and second coaxial cables respectively, said second element being coupled to the second end of the center conductor of said second coaxial cable and said third element being coupled to the junction between the shields of said first and second coaxial cables, said second coaxial cable having an electrical length equal approximately to an integral multiple of one-half wavelengths at the frequency at which said first and second elements are half-wave resonant, said high permeability core decoupling energy in said antenna from the exterior of said feedline.

2. A multiple frequency band antenna as defined by claim 1 which further comprises a support structure and wherein said second coaxial cable is coiled and suspended from said support structure, said high permeability core also being suspended from said support structure.

3. A multiple frequency band antenna as defined by claim 1 which further comprises a fourth conductive radiation element attached between the first and second ends of the center conductor of said second coaxial cable.

4. A multiple frequency band antenna as defined by claim 1 which further comprises reactance components connected in series with said first, second and third conductive radiation elements.

5. A multiple frequency band antenna as defined by claim 4 wherein said reactance components comprise resonant circuits.

6. A multiple frequency band antenna as defined by claim 1 wherein the second end of the conductive shield of said first coaxial cable is connected to the first end of the conductive shield of said second coaxial cable.

7. A multiple frequency band antenna as defined by claim 1 wherein the first and second ends of the conductive shield of said second coaxial cable are connected together.

* * * * *